US008520877B1

(12) United States Patent
Peng et al.

(10) Patent No.: US 8,520,877 B1
(45) Date of Patent: Aug. 27, 2013

(54) RESONANT STRUCTURE FOR LOUDSPEAKER

(75) Inventors: Jack Peng, Taoyuan (TW); Yeh-Feng Chou, Taoyuan (TW)

(73) Assignee: Meiloon Industrial Co., Ltd., Taoyuan (TW)

( * ) Notice: Subject to any disclaimer, the term of this patent is extended or adjusted under 35 U.S.C. 154(b) by 21 days.

(21) Appl. No.: 13/451,628

(22) Filed: Apr. 20, 2012

(51) Int. Cl.
*H04R 25/00* (2006.01)

(52) U.S. Cl.
USPC ..... 381/345; 381/387; 381/189; 381/433

(58) Field of Classification Search
USPC ..... 381/345, 351–354, 386–389, 395, 381/189, 396, 433
See application file for complete search history.

(56) References Cited

U.S. PATENT DOCUMENTS

| | | | | |
|---|---|---|---|---|
| 7,894,620 | B2 * | 2/2011 | Yang | 381/345 |
| 7,954,435 | B2 * | 6/2011 | Severson | 381/345 |
| 8,091,681 | B2 * | 1/2012 | Stewart et al. | 381/345 |
| 8,139,811 | B2 * | 3/2012 | Itoh et al. | 381/396 |

* cited by examiner

*Primary Examiner* — Suhan Ni
(74) *Attorney, Agent, or Firm* — Jackson IPG PLLC

(57) ABSTRACT

A resonant structure for loudspeaker includes a basket defining a front opening and having an annular magnet mounted therein; a voice coil suspended inside the magnet; a diaphragm connected at a suspended flange to the front opening of the basket; at least one flexible suspension member spaced behind the diaphragm for connecting to a rear opening of the basket; and an inner frame having a front end glued to a rear wall surface of the diaphragm, a central area to the voice coil and a rear wing member to the flexible suspension member. When the voice coil moves forward and backward on the inner frame, best possible harmonic resonance between the diaphragm and the flexible suspension members can be obtained. The loudspeaker is effectively reduced in height, and bass response is enhanced to ensure upgraded sound quality.

16 Claims, 8 Drawing Sheets

RESONANT STRUCTURE FOR LOUDSPEAKER

FIELD OF THE INVENTION

The present invention relates to a resonant structure for loudspeaker, and more particularly to a resonant structure for loudspeaker that includes an inner frame between a diaphragm and a flexible suspension member, so that when a voice coil moving forward and backward, the best possible harmonic resonance between the diaphragm and the flexible suspension member can be obtained; meanwhile, the loudspeaker is effectively reduced in height, and bass response is enhanced to ensure upgraded sound quality.

BACKGROUND OF THE INVENTION

With the quick progress in many technological fields and the largely upgraded living quality, the conventional large-size and expensive cathode ray tube (CRT) television has been gradually replaced by the light and slim liquid-crystal display (LCD) television. The LCD television has a large-size and high-definition screen to provide ideal image quality, allowing a viewer to enjoy the fun of telepresence. Moreover, the LCD television can be easily positioned without occupying a large space, and it can be laid on a conventional television cabinet or hung on a wall in a living room. That is why the LCD television is widely welcomed among consumers.

FIG. 1 is an assembled sectional view showing the structure of a conventional loudspeaker. As shown, the loudspeaker includes a basket having an expanded front opening, and an annular magnet mounted to a bottom of the basket, a voice coil located inside the annular magnet, a diaphragm glued to between the expanded front opening of the basket and the voice coil, and a flexible suspension ring located behind and spaced from the diaphragm. While the conventional loudspeaker with the above structure provides good sound quality, it has a relatively big volume in a fully assembled state and is therefore not suitable for mounting in an audio/visual (A/V) product that has a very limited inner space. In other words, the conventional loudspeaker must be correspondingly reduced in size to match the small inner space of the new-generation A/V product. However, being restricted by the structural design thereof, even if the conventional loudspeaker can be proportionally reduced as much as possible in size and in exterior appearance, it must always have a considerable height in a fully assembled state to maintain effective resonance of the produced sound waves.

Particularly, to match the contour of the A/V products, the current loudspeaker must be as small as possible to even have a narrow and long configuration. Under this condition, not only the diaphragm but also the flexible suspension member of the loudspeaker must also have a substantially oval or oblong shape. With the oval or oblong shape, the flexible suspension member and the diaphragm in practical application are faced leftward/rightward or upward/downward to result in less harmonic resonance between them. This will seriously affect the quality of sound output by the loudspeaker and result in relatively poor sound effect, forming a biggest disadvantage of the LCD television.

SUMMARY OF THE INVENTION

It is therefore a primary object of the present invention to provide an improved resonant structure for loudspeaker, which includes a basket defining a front opening and having an annular magnet mounted to a bottom thereof; a voice coil suspended inside the annular magnet; a diaphragm having a suspended flange formed therearound for gluing to the front opening; at least one flexible suspension member located behind and spaced from the diaphragm to connect to a rear opening of the basket; and an inner frame being glued at a front end to a rear wall surface of the diaphragm and at a central portion to the voice coil, and including at least one wing member located behind the inner frame and glued to the at least one flexible suspension member.

With these arrangements, when the voice coil moves forward and backward with the aid of the inner frame, the best possible harmonic resonance between the diaphragm and the flexible suspension members can be obtained. Further, the loudspeaker in a fully assembled state is effectively reduced in height, and bass response is enhanced to ensure upgraded sound quality.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
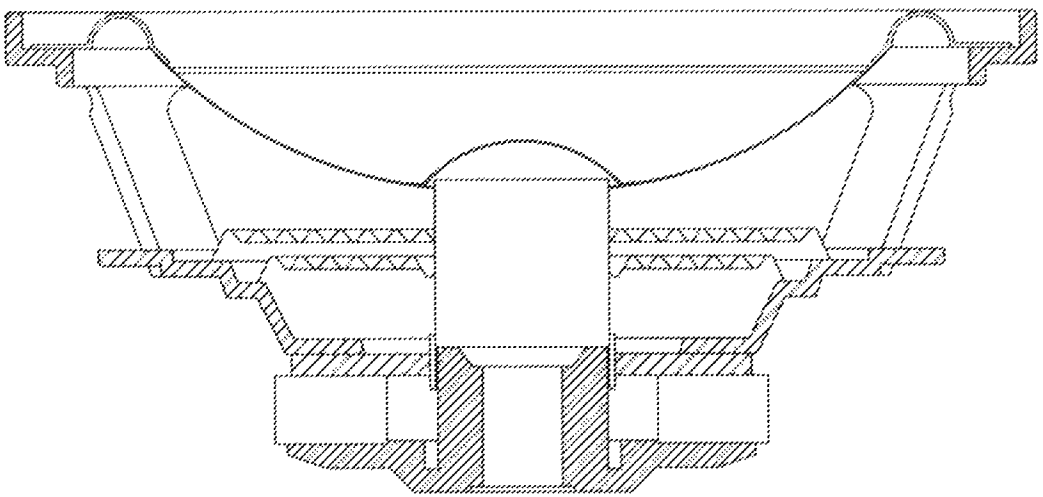
FIG. 1 PRIOR ART
FIG. 1 is an assembled sectional view showing the structure of a conventional loudspeaker.

The present invention will now be described with some preferred embodiments thereof and with reference to the accompanying drawings. For the purpose of easy to understand, elements that are the same in the preferred embodiments are denoted by the same reference numerals.

Figure 2:
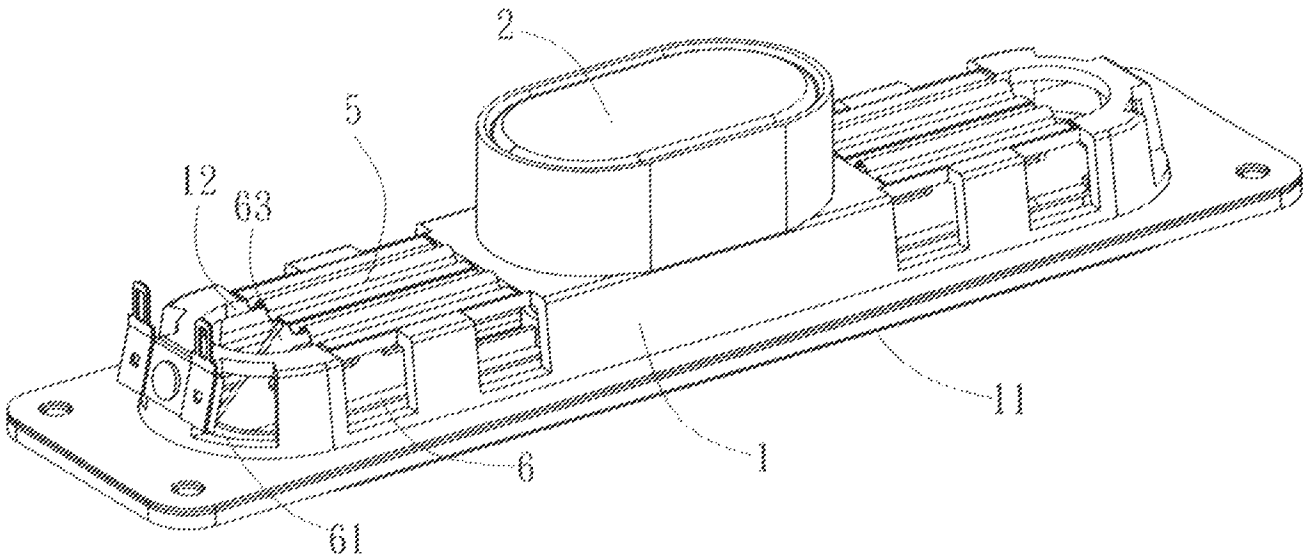
FIG. 2 is an assembled rear perspective view of a resonant structure for loudspeaker according to a first embodiment of the present invention.
Figure 3:
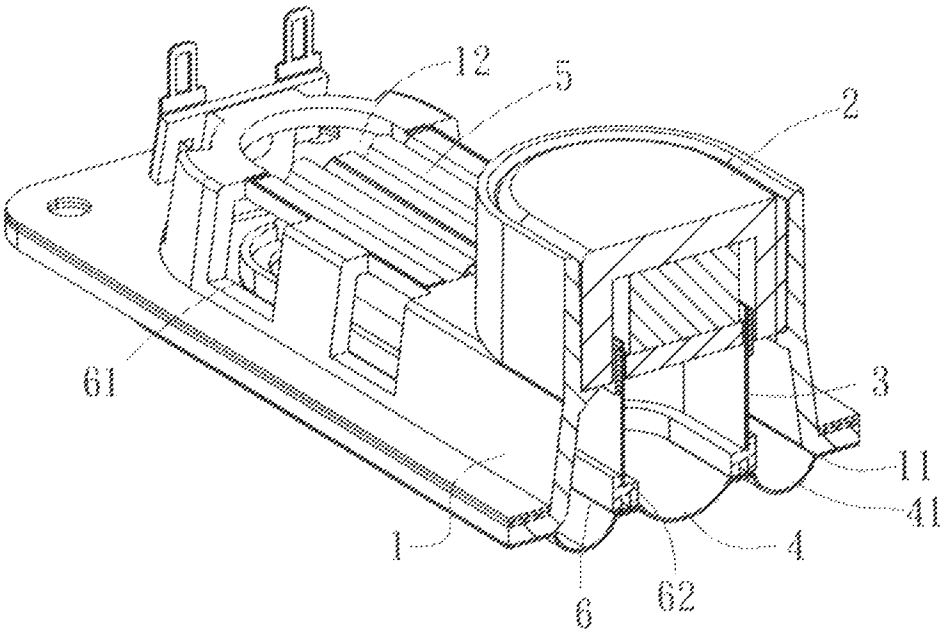
FIG. 3 is a cross sectional perspective view of the resonant structure for loudspeaker shown in FIG. 2.
Figure 4:
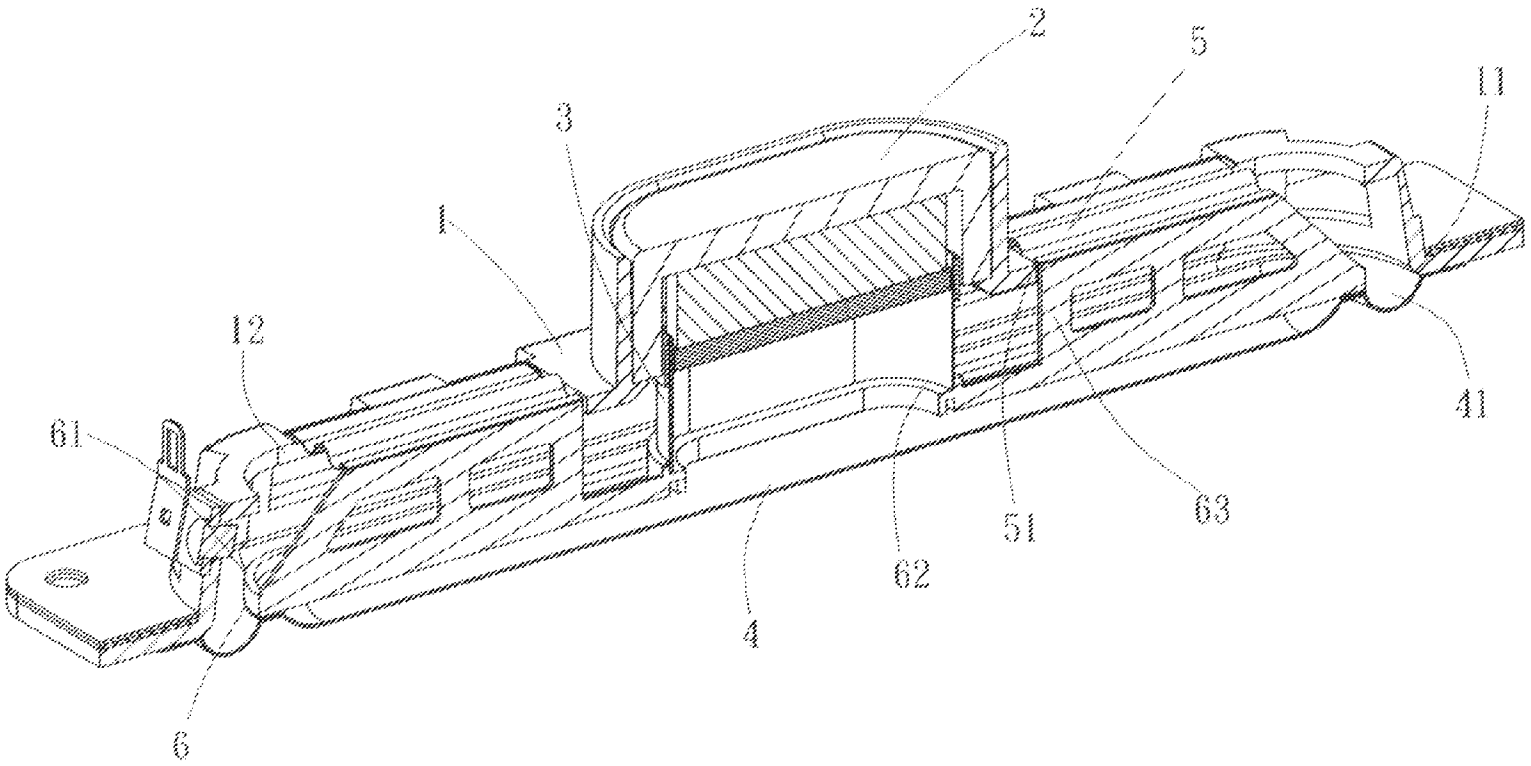
FIG. 4 is a longitudinal sectional perspective view of the resonant structure for loudspeaker shown in FIG. 2.

Please refer to FIGS. 2 to 4. A resonant structure for loudspeaker according to a first embodiment of the present invention includes a basket 1 defining a front opening 11 and having an annular magnet 2 mounted to a bottom thereof; a voice coil 3 suspended inside the annular magnet 2; a diaphragm 4 having a suspended flange 41 formed therearound for gluing to the front opening 11; at least one flexible suspension member 5 located behind and spaced from the diaphragm 4 to connect to a rear opening 12 of the basket 1; and an inner frame 6 including a horizontally extended front frame member 61, a seat portion 62 rearward recessed from a central portion of the front frame member 61, at least one wing member 63 perpendicularly located behind the front frame member 61 adjacent to one longitudinal end of the seat portion 62. The inner frame 6 is glued at a front end to a rear wall surface of the diaphragm 4, and at the central portion to the voice coil 3. Meanwhile, the at least one wing member 63 located behind the front frame member 61 of the inner frame 6 is glued to the at least one flexible suspension member 5.

Please refer to FIGS. 3 and 4. In practical implementation of the present invention, the basket 1 is further reduced into a substantially flat oblong configuration. The diaphragm 4 also has a narrow long shape corresponding to the oblong basket 1. In manufacturing the loudspeaker, the diaphragm 4 can be integrally formed with the inner frame 6. The annular magnet 2, the voice coil 3, and the central seat portion 62 of the inner frame 6 all are oblong or round in shape. Since the basket 1 is oblong in shape, two rear openings 12 can be formed on the basket 1 at two longitudinally opposite sides of the annular magnet 2, and two flexible suspension members 5 can be provided for connecting to the two rear openings 12. Every flexible suspension member 5 is configured as a corrugated sheet having a plurality of parallelly spaced flutes. In the first embodiment, the flutes are extended parallel with two longer edges of the oblong basket 1. The horizontally extended front frame portion 61 is also substantially oblong in shape. Each of the two wing members 63 is extended between one of two longitudinally opposite end walls of the central seat portion 62 and a corresponding one of two longitudinally opposite ends of the front frame member 61, and is glued at a rear edge to a middle flute 51 of the flexible suspension member 5.

Figure 5:
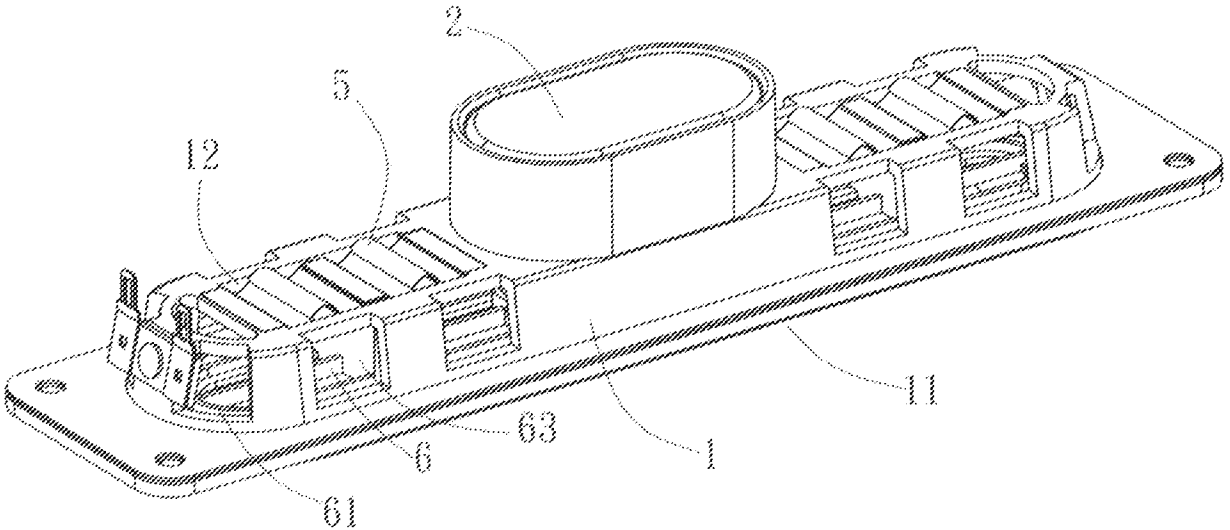
FIG. 5 is an assembled rear perspective view of a resonant structure for loudspeaker according to a second embodiment of the present invention.
Figure 6:
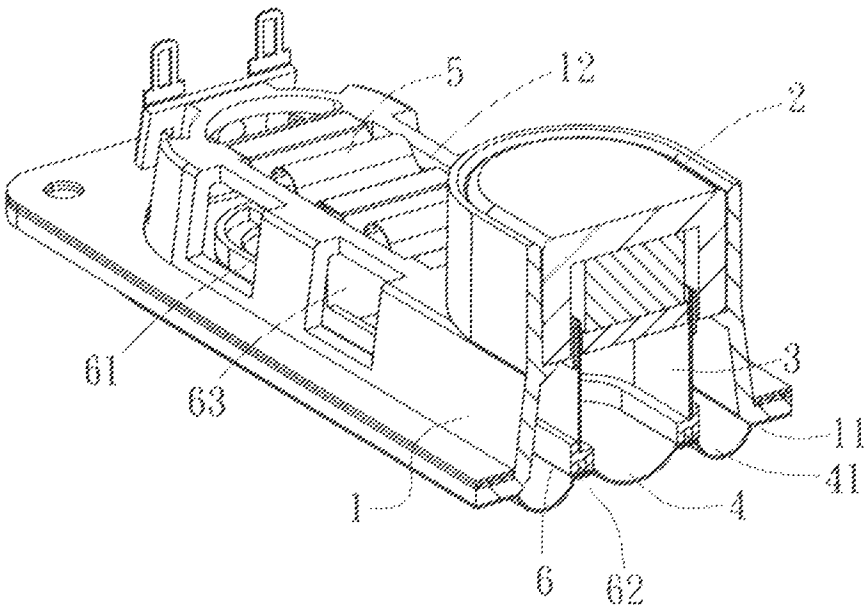
FIG. 6 is a cross sectional perspective view of the resonant structure for loudspeaker shown in FIG. 5.
Figure 7:
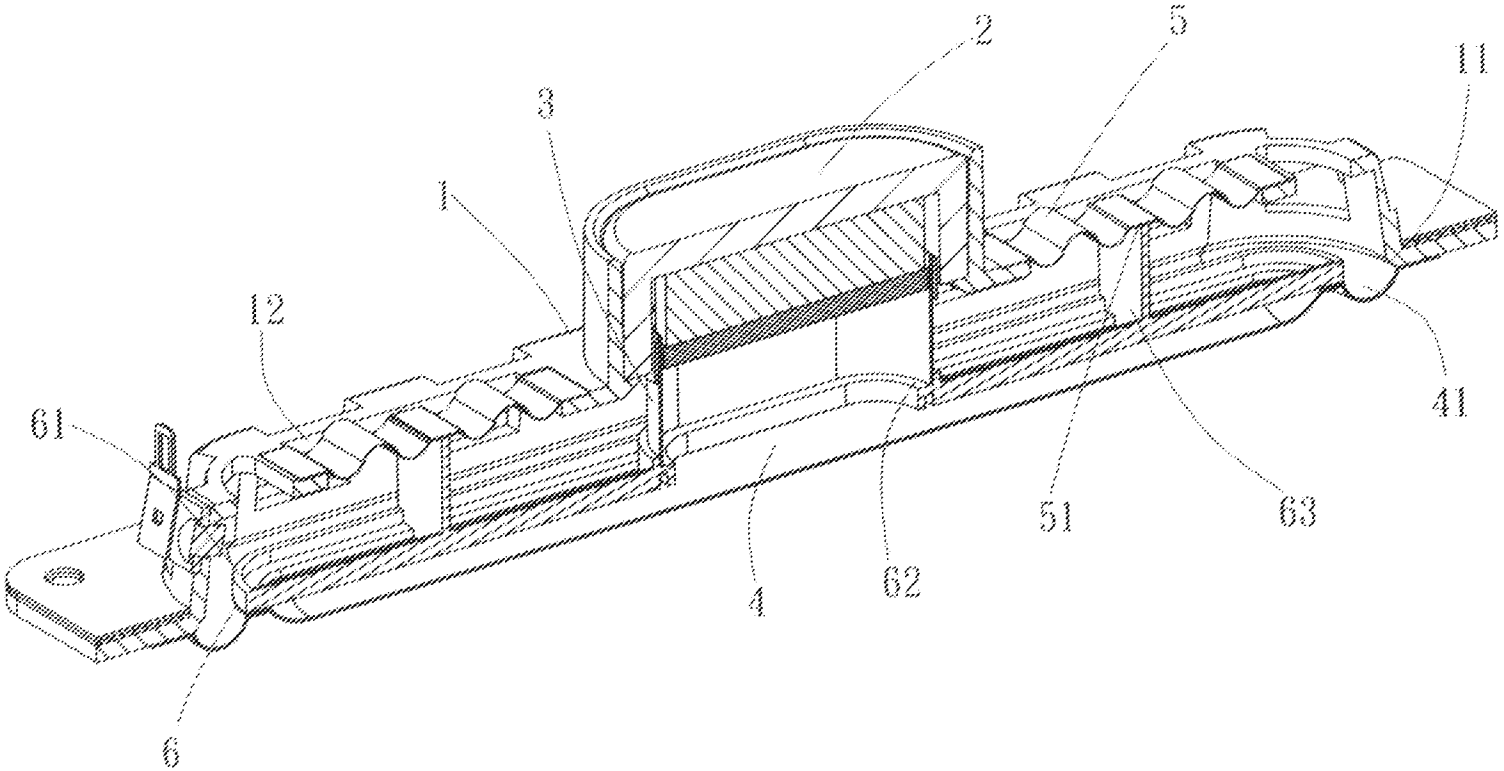
FIG. 7 is a longitudinal sectional perspective view of the resonant structure for loudspeaker shown in FIG. 5.

FIGS. 5 to 7 show a resonant structure for loudspeaker according to a second embodiment of the present invention. The second embodiment is generally structurally similar to the first embodiment, except that the flutes of the flexible suspension members 5 are extended parallel with two shorter edges of the oblong basket 1. In the second embodiment, the inner frame 6 also includes a horizontally extended oblong-shaped front frame member 61, and two wing members 63 are perpendicularly located behind the front frame member 61 to space from two longitudinally opposite end walls of the central seat portion 62. Similarly, the wing members 63 are glued at respective rear edge to the central flutes 51 of the two flexible suspension members 5.

Therefore, as shown in FIGS. 2 to 7, two large enough flexible suspension members 5 can be provided to two rear openings 12 of the basket 1 for two wing members 63 located behind the inner frame 6 to glue at rear ends to the flexible suspension members 5. With these arrangements, when the loudspeaker is fully assembled, a height measured from the annular magnet 2 to the front opening can be further reduced, which enables effective reduction of an overall volume of the loudspeaker and accordingly, allows the loudspeaker to be mounted in, for example, an LCD television that has very limited inner space, or in other electric appliances that have increasingly reduced volume.

Figure 8:
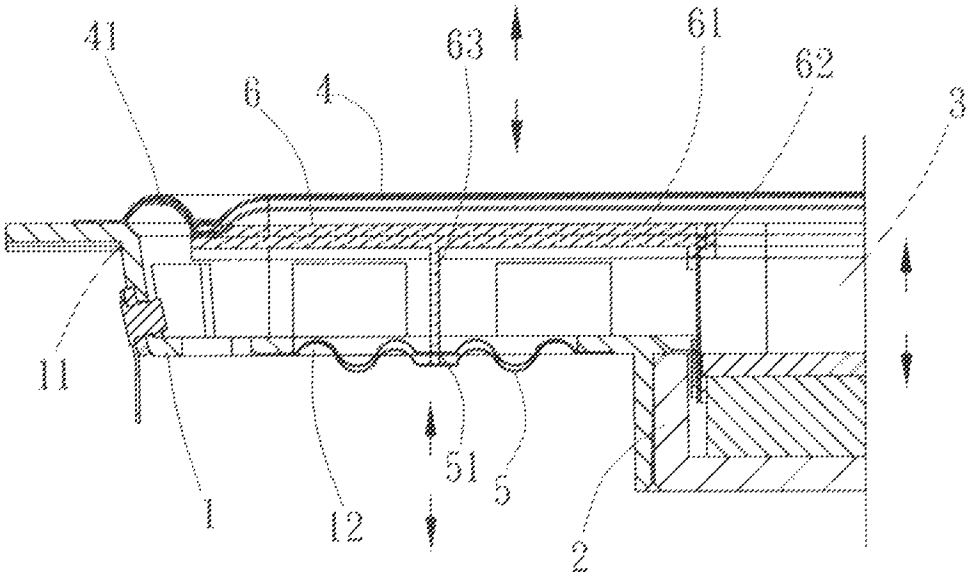
FIG. 8 is a fragmentary sectional view showing the resonant structure for loudspeaker according to the present invention in use.

FIG. 8 is a fragmentary sectional view showing the resonant structure for loudspeaker according to the present invention in use. Since the central seat portion 62 of the inner frame 6 is glued to the voice coil 3, the front frame member 61 of the inner frame 6 is glued to the rear wall surface of the diaphragm 4, and the two wing members 63 perpendicularly located behind the front frame member 61 are glued to the two flexible suspension members 5, the best possible harmonic resonance between the diaphragm 4 and the flexible suspension members 5 can be obtained, when the loudspeaker outputs sound, with the aid of the inner frame 6, assisting the voice coil 3 to move forward and backward as in a piston motion. In this manner, the voice coil 3 can have good conforming flexibility to vibrate stably, so that the loudspeaker can properly enhance bass response to produce good acoustic resonance, and well coordinates power and sound wave to ensure upgraded sound quality. Therefore, with the present invention, a dimension-reduced cabinet can still create the same good sound effect as a big-size cabinet.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A resonant structure for loudspeaker, comprising:

a basket defining a front opening and having an annular magnet mounted to a bottom thereof;

a voice coil suspended inside the annular magnet;

a diaphragm having a suspended flange formed therearound for gluing to the front opening;

at least one flexible suspension member being located behind and spaced from the diaphragm to connect to a rear opening of the basket; and an inner frame being glued at a front end to a rear wall surface of the diaphragm and at a central portion to the voice coil; and the inner frame including at least one wing member located behind the inner frame and glued to the at least one flexible suspension member;

whereby, when the voice coil moves forward and backward with the aid of the inner frame, a best possible harmonic resonance between the diaphragm and the flexible suspension member can be obtained, the loudspeaker in a fully assembled state can have an effectively reduced overall height, and an enhanced bass response can be obtained to ensure upgraded sound quality.

2. The resonant structure for loudspeaker as claimed in claim 1, wherein the diaphragm is integrally formed with the inner frame.

3. The resonant structure for loudspeaker as claimed in claim 2, wherein the inner frame further includes a horizontally extended front frame member and a seat portion recessed from a central portion of the front frame member, and the at least one wing member being perpendicularly located behind the front frame member at one of two opposite sides of the central seat portion; and wherein the at least one flexible suspension member is a corrugated sheet having a plurality of parallelly spaced flutes, and the at least one wing member being glued at a rear edge to a middle one of the flutes.

4. The resonant structure for loudspeaker as claimed in claim 3, wherein the basket is reduced into a flat oblong shape, and has two rear openings formed thereon to locate at two longitudinally opposite sides of the annular magnet for two flexible suspension members to connect thereto.

5. The resonant structure for loudspeaker as claimed in claim 4, wherein the flutes on the two flexible suspension members are extended parallel with two longer edges of the basket, the front frame member of the inner frame is in an oblong shape, and there are two wing members perpendicularly located behind the front frame member to respectively extend between one of two longitudinally opposite end walls of the central seat portion and a corresponding one of two longitudinally opposite ends of the front frame member.

6. The resonant structure for loudspeaker as claimed in claim 5, wherein the diaphragm has a narrow long shape corresponding to the oblong basket, and the annular magnet, the voice coil and the central seat portion are oblong or round in shape.

7. The resonant structure for loudspeaker as claimed in claim 4, wherein the flutes on the two flexible suspension members are extended parallel with two shorter edges of the basket, the front frame member of the inner frame is in an oblong shape, and there are two wing members perpendicularly located behind the front frame member to space from two longitudinally opposite end walls of the central seat portion.

8. The resonant structure for loudspeaker as claimed in claim 7, wherein the diaphragm has a narrow long shape corresponding to the oblong basket, and the annular magnet, the voice coil and the central seat portion are oblong or round in shape.

9. The resonant structure for loudspeaker as claimed in claim 4, wherein the diaphragm has a narrow long shape corresponding to the oblong basket, and the annular magnet, the voice coil and the central seat portion are oblong or round in shape.

10. The resonant structure for loudspeaker as claimed in claim 1, wherein the inner frame further includes a horizontally extended front frame member and a seat portion recessed from a central portion of the front frame member, and the at least one wing member being perpendicularly located behind the front frame member at one of two opposite sides of the central seat portion; and wherein the at least one flexible suspension member is a corrugated sheet having a plurality of parallelly spaced flutes, and the at least one wing member being glued at a rear edge to a middle one of the flutes.

11. The resonant structure for loudspeaker as claimed in claim 10, wherein the basket is reduced into a flat oblong shape, and has two rear openings formed thereon to locate at two longitudinally opposite sides of the annular magnet for two flexible suspension members to connect thereto.

12. The resonant structure for loudspeaker as claimed in claim 11, wherein the flutes on the two flexible suspension members are extended parallel with two longer edges of the basket, the front frame member of the inner frame is in an oblong shape, and there are two wing members perpendicularly located behind the front frame member to respectively extend between one of two longitudinally opposite end walls of the central seat portion and a corresponding one of two longitudinally opposite ends of the front frame member.

13. The resonant structure for loudspeaker as claimed in claim 12, wherein the diaphragm has a narrow long shape corresponding to the oblong basket, and the annular magnet, the voice coil and the central seat portion are oblong or round in shape.

14. The resonant structure for loudspeaker as claimed in claim 11, wherein the flutes on the two flexible suspension members are extended parallel with two shorter edges of the basket, the front frame member of the inner frame is in an oblong shape, and there are two wing members perpendicularly located behind the front frame member to space from two longitudinally opposite end walls of the central seat portion.

15. The resonant structure for loudspeaker as claimed in claim 14, wherein the diaphragm has a narrow long shape corresponding to the oblong basket, and the annular magnet, the voice coil and the central seat portion are oblong or round in shape.

16. The resonant structure for loudspeaker as claimed in claim 11, wherein the diaphragm has a narrow long shape corresponding to the oblong basket, and the annular magnet, the voice coil and the central seat portion are oblong or round in shape.

* * * * *